US007178533B2

(12) United States Patent
Andrion

(10) Patent No.: US 7,178,533 B2
(45) Date of Patent: Feb. 20, 2007

(54) BEVERAGE CONTAINER AND TOOTHBRUSH HOLDER

(76) Inventor: Gil N. Andrion, 1901 Stockmeyer, Westland, MI (US) 48186

( * ) Notice: Subject to any disclaimer, the term of this patent is extended or adjusted under 35 U.S.C. 154(b) by 345 days.

(21) Appl. No.: 10/686,637

(22) Filed: Oct. 17, 2003

(65) Prior Publication Data

US 2005/0081879 A1 Apr. 21, 2005

(51) Int. Cl.
*A45D 44/18* (2006.01)

(52) U.S. Cl. ..... 132/308

(58) Field of Classification Search ..... 132/289, 132/308–310, 314; 206/217, 361, 362.2, 206/38, 581; 215/6; 222/130
See application file for complete search history.

(56) References Cited

U.S. PATENT DOCUMENTS 1,691,814 A * 11/1928 King ..... 15/184
D100,412 S * 7/1936 Carp ..... D9/744
2,970,720 A 2/1961 Dooley
3,225,951 A * 12/1965 Poston et al. ..... 215/6
3,732,999 A * 5/1973 Rounkles ..... 215/6
4,098,397 A * 7/1978 Mann et al. ..... 206/217
4,235,343 A * 11/1980 Thompson ..... 215/6
4,530,129 A * 7/1985 Labick et al. ..... 15/184
4,821,752 A * 4/1989 Widlak ..... 132/309
4,903,848 A 2/1990 Chattman
4,950,083 A * 8/1990 Bavaveas ..... 366/348
5,050,757 A * 9/1991 Hidding et al. ..... 220/23.83
5,065,875 A * 11/1991 Balavich ..... 215/10
D325,341 S * 4/1992 Balavich ..... D9/744
D325,342 S * 4/1992 Balavich ..... D9/744
5,135,116 A * 8/1992 Panzetti ..... 215/10
5,215,193 A * 6/1993 Dennis ..... 206/223
5,316,398 A * 5/1994 Chandaria et al. ..... 401/18
5,484,065 A 1/1996 Davoli, Jr. et al.
6,202,963 B1 3/2001 Derman
6,220,253 B1 * 4/2001 Wright ..... 132/310
6,782,999 B1 * 8/2004 McCoy et al. ..... 206/223

* cited by examiner

*Primary Examiner*—Cris L. Rodriguez
*Assistant Examiner*—Rachel A. Running
(74) *Attorney, Agent, or Firm*—Charles W. Chandler

(57) ABSTRACT

A beverage container having a recessed storage compartment in the container wall for storing a toothbrush and a tube of toothpaste. The compartment has access through an exterior opening in the wall so that the toothbrush and toothpaste are dry, when the container contains a liquid.

6 Claims, 4 Drawing Sheets

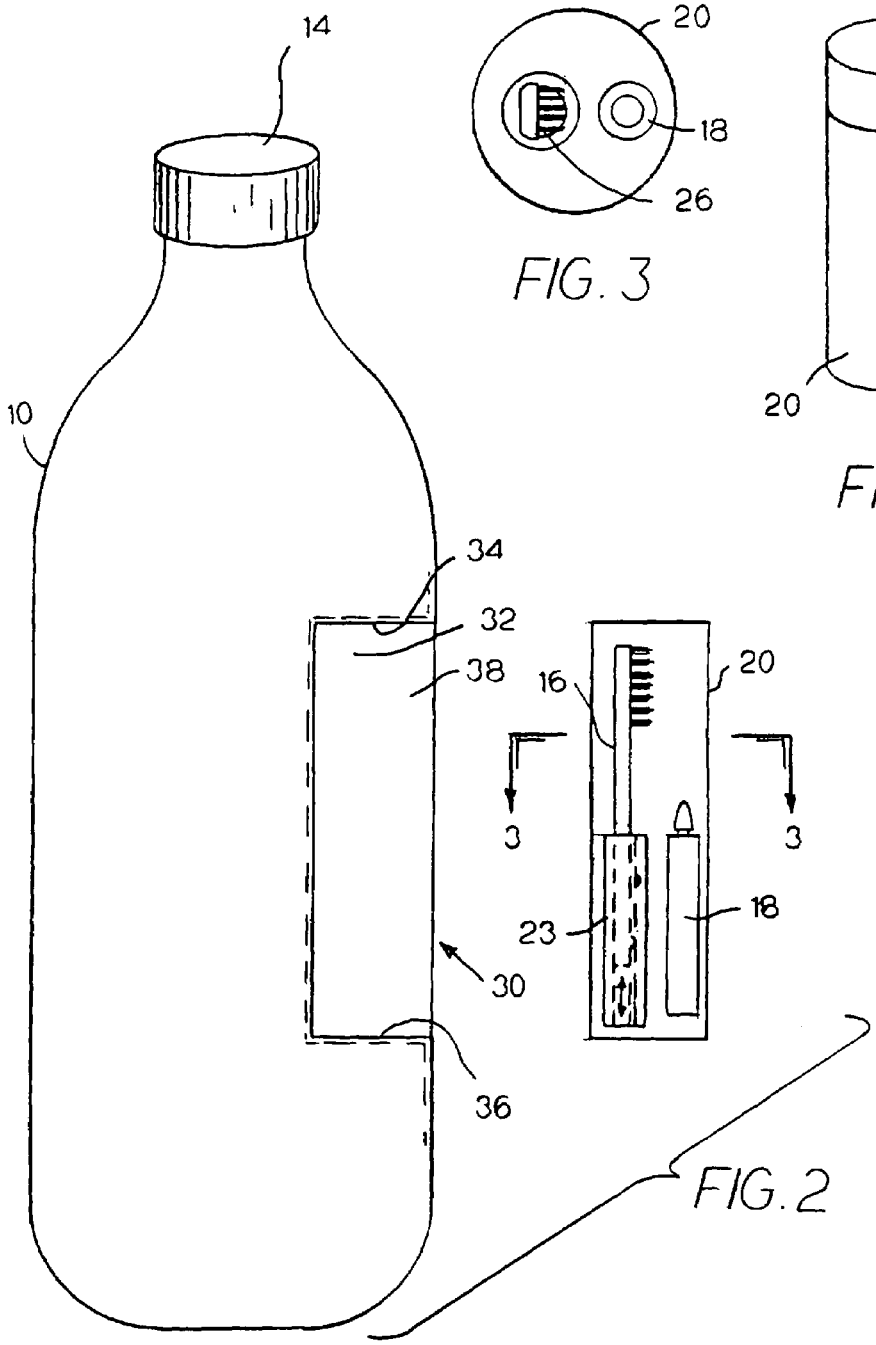
FIG. 2
FIG. 3
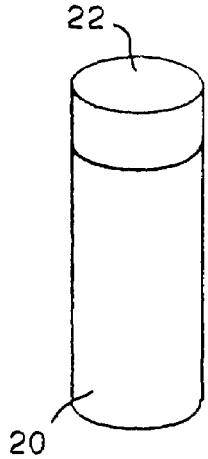
FIG. 4

BEVERAGE CONTAINER AND TOOTHBRUSH HOLDER

BACKGROUND AND SUMMARY OF THE INVENTION

This invention relates to a container (bottle) which contains a beverage such as mineral water, and has a recessed storage area for storing a toothbrush and toothpaste.

Travelers and others commonly carry mineral water. Occasionally, they want to cleanse their mouth and teeth, however, their toothbrush is not readily available.

Some art related to this invention includes U.S. Pat. No. 6,202,963 issued Mar. 20, 2001 to Jay S. Derman for "Razor and Toothbrush Holder Attachment for Stand Up Dispenser Tubes"; U.S. Pat. No. 5,484,065 issued Jan. 16, 1996 to Frank Davoli, Jr. et al. for "Drinking Vessel-Disposable Toothbrush Holder"; U.S. Pat. No. 4,903,848 issued Feb. 27, 1990 to Ronald Chattman for "Mouthwash Packaging" and U.S. Pat. No. 2,970,720 issued Feb. 7, 1961 to William T. Dooley for "Disappearing Article Holding Device".

The broad purpose of the present invention is to provide a combination beverage container and toothbrush and toothpaste storage container. Still further objects and advantages of the invention will become readily apparent to those skilled in the art to which the invention pertains.

DESCRIPTION OF THE DRAWINGS

The description refers to the accompanying drawings in which like reference characters refer to like parts throughout the several views, and in which:

FIG. 2 is an exploded view showing the toothbrush container being inserted into a recess in the beverage bottle;

FIG. 3 is a sectional view as seen along lines 3—3 of FIG. 2;

FIG. 4 is a view of the toothbrush and toothpaste container;

DESCRIPTION OF THE PREFERRED EMBODIMENT

Figure 1:
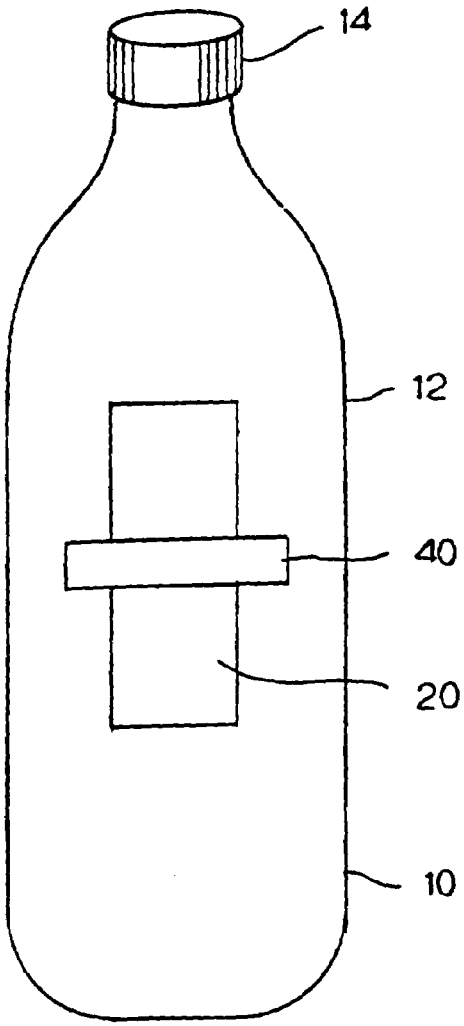
FIG. 1 illustrates a beverage container with a toothbrush and toothpaste compartment.

Referring to the drawings, FIG. 1 illustrates a symmetrical container 10 of the type commonly used for holding water, mineral water and the like. Container 10 has an elongated body 12 and a cap 14.

An extendible toothbrush 16 and a small tube of toothpaste 18 are contained within a cylindrical case 20. Case 20 has a cap 22 for retaining the contents of the container.

Figure 5:
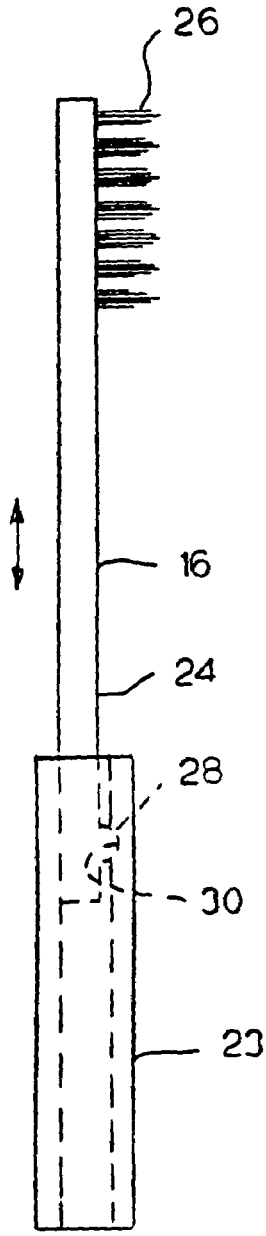
FIG. 5 is a view showing the collapsible toothbrush in its expanded position.

Referring to FIG. 5, toothbrush 16 has a hollow body 22, a handle 24 and a brush 26. The hollow body receives handle 24 so that the handle can be extended to the position shown in FIG. 5 in which an internal enlargement 28 on the handle engages a recess 30 in the body to hold the toothbrush in an extended position.

Toothbrush 16 also has a retracted condition illustrated in FIG. 2.

For illustrative purposes, container 10 has a height of about 8.5 inches. The body of the container has an elongated recess 32 for receiving case 20 and its contents. When case 20 is inserted in recess 32, the outside surface of the width of the case is flush with the external profile of container 10 as illustrated in FIG. 1.

Recess 30 has a top 34, a bottom 36 and a semi-cylindrical wall 38. The top and bottom are joined to cylindrical wall 38 to form a watertight enclosure for case 20. When case 20 is inserted in recess 30, a section of adhesive tape 40 is attached to the opposite sides of the recess, and to the case to hold them in position until the toothbrush is to be used. The recess has height of about 4 inches. Wall 38 has a diameter slightly larger than the diameter of the inside surface of case 20 which preferably is about 1 inch in diameter.

In use, the user inserts case 20 into the recess. He then can carry the container, filled with, for example mineral water, until such time as he feels that he desires to cleanse his mouth. He removes tape 40 and case 20, removes cap 22 and then uses the contents, that is toothbrush 16 and toothpaste 18.

Figure 6:
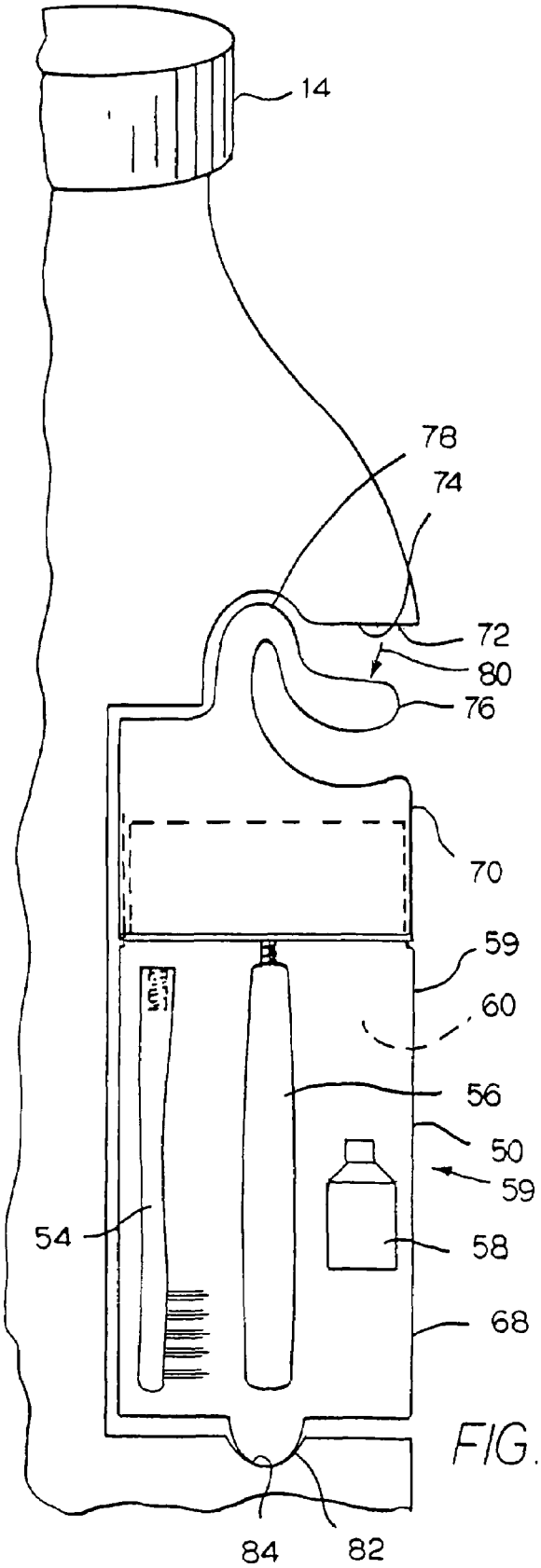
FIG. 6 is a view of another embodiment of the invention.
Figure 7:
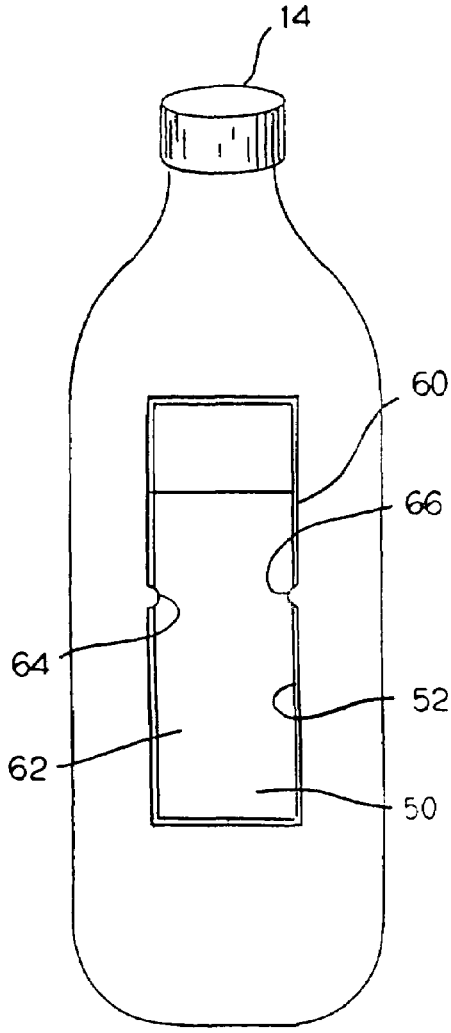
FIG. 7 is a view of as seen from the right side of FIG. 6.

FIGS. 6 and 7 illustrate another embodiment of the invention which also comprises a container 50 having a recess 52. The handle of a toothbrush 54, a shaving razor 56, and a tube of toothpaste 58 are inserted in a case 59 into recess 60 of container 50. In this case, a cap 62 is snapped over the recess opening and held in place by a pair of raised lips 64 and 66 on opposite sides of the recess.

Case 59, used for storing the toothbrush, toothpaste and razor, comprises a cylindrical body 68 and a clip-on cap 70 which telescopically receives the upper end of body 68. The upper end of recess 60 has a fairly flat portion 72 with an internal recess 74. Cap 70 has a finger 76 which in its normal position supports a shoulder 78 that is snapped into recess 74. Finger 76 is resilient in such a manner that it can be passed downwardly in the direction of arrow 80 to remove shoulder 78 from the recess. When the case is to be inserted into the recess, the user pushes the case into the recess in such a manner that shoulder 78 bends downwardly a distance sufficient to enter and be retained in recess 74. At the same time, a protuberance 82 at the bottom of case 59 is received by a recess 84.

Figure 8:
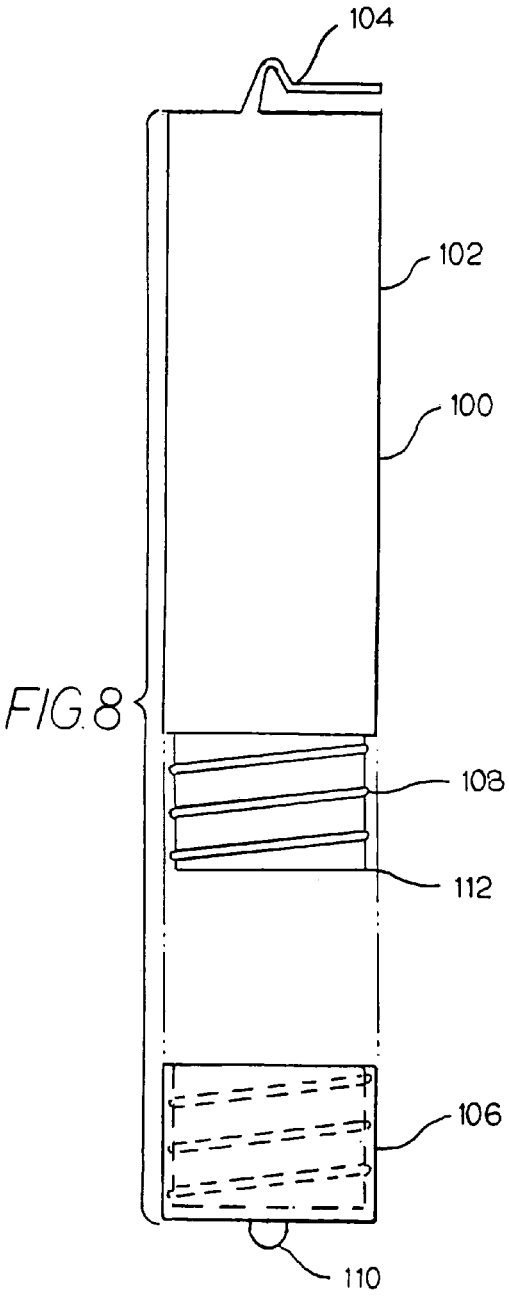
FIGS. 8 and 9 illustrate another embodiment of the invention.
Figure 9:
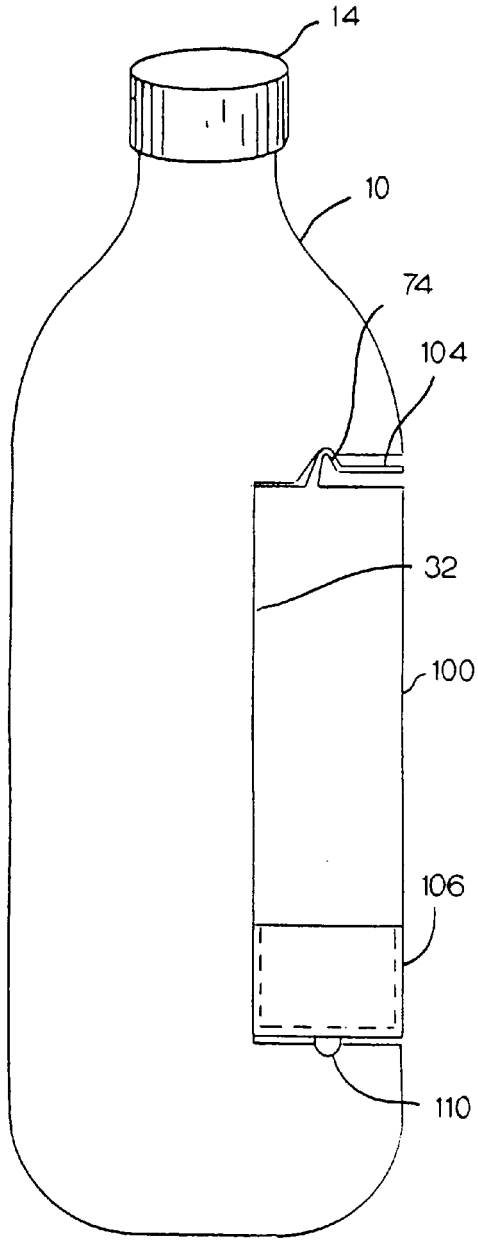

Referring to FIGS. 8 and 9, another embodiment of the invention is illustrated and comprises a case 100 having a cylindrical body 102 with a resilient finger 104 which snaps into the opening of recess 74 in the bottle. When finger 104 is depressed by the user, it can be removed from recess 32. The case 102 can also be inserted into the recess by pushing the case into the recess until the finger snaps into recess 74. In this case, the case has a cap 106 threadably mounted on the lower end of the body of the case on a cylindrical threaded section 108. The cap has a dispensing element 110. The cap 106 can be mounted on the top of container 10 by removing cap 14 and screwing on cap 106. The user can then remove the contents of the bottle by squeezing on the bottle. In this case, the container would have a resilient or squeezable configuration. The lower end of the case has a thin pad 112 to prevent the contents of the case from being accidentally removed. When the user wants to remove the contents of the case, he will use a tool or his finger to penetrate through barrier 112 and open the bottom of the case.

Having described my invention, I claim:

1. A combination bottle and toothbrush holder comprising:

an elongated body having a top opening and an outer symmetrical profile and an elongated integral recess, the recess having wall means forming a liquid-tight enclosure such that a liquid contained in the body will not pass through the recess of the bottle;

a cap threadably mounted on the top opening of the body;

a cylindrical case receivable in said recess;

a toothbrush and a tube of toothpaste received in the cylindrical case;

the case being receivable in the recess to a stored position in which the outside surface of the case forms a continuation of the profile of the body;

means for releasably holding the case in the recess; and a cap for the cylindrical case, slidably received over an upper end of the case;

wherein the body has a second recess, and the case has a finger resiliently received in said second recess.

2. A combination as defined in claim 1, in which a length of tape is adhesively attached to the container on opposite sides of the recess.

3. A combination as defined in claim 1, in which the toothbrush has an elongated hollow body, a handle with a brush receivable in said hollow body such that the handle is movable between a stored position and an extended position; and means for holding the handle in said extended position.

4. A combination as defined in claim 1, including a razor storable in said case.

5. A combination bottle and toothbrush holder comprising:

an elongated body having a top opening and an outer symmetrical profile and an elongated integral recess, the recess having wall means forming a liquid-tight enclosure such that a liquid contained in the body will not pass through the recess of the bottle;

a cap threadably mounted on the top opening of the body;

a cylindrical case received in said recess;

a toothbrush and a tube of toothpaste received in the cylindrical case;

the case being receivable in the recess to a stored position in which the outside surface of the case forms a continuation of the profile of the body;

means for releasably holding the case in the recess; and a second cap threadably on the case, the second cap being threadably mounted on the top opening of the body when the first mentioned cap has been separated from said top opening.

6. A combination as defined in claim 5, in which the body has resilient walls, and including a spout on the second cap for removing a liquid from said body when the second cap is mounted on the body.

* * * * *